US006477976B2

(12) United States Patent
Van Gelder

(10) Patent No.: US 6,477,976 B2
(45) Date of Patent: Nov. 12, 2002

(54) RECREATION WATER SLED

(76) Inventor: Terry L Van Gelder, 1164 Lehner Ave., Escondido, CA (US) 92026

( * ) Notice: Subject to any disclaimer, the term of this patent is extended or adjusted under 35 U.S.C. 154(b) by 0 days.

(21) Appl. No.: 09/836,138

(22) Filed: Apr. 16, 2001

(65) Prior Publication Data

US 2002/0151232 A1 Oct. 17, 2002

(51) Int. Cl.[7] ..... B63B 21/04
(52) U.S. Cl. ..... 114/253; 441/65; 441/71
(58) Field of Search ..... 114/162, 144 R, 114/271, 274, 283, 291, 253; 441/65, 71, 72, 79; D12/307, 316; D21/769, 770

(56) References Cited

U.S. PATENT DOCUMENTS 2,940,091 A * 6/1960 Fifer ..... 441/71
D192,947 S * 5/1962 Tetyak ..... D12/307
3,835,492 A * 9/1974 Orchowski ..... 114/356
4,302,858 A * 12/1981 Casciano ..... 114/253
4,730,572 A * 3/1988 Hollingsworth ..... 114/283
4,944,240 A * 7/1990 Morris ..... 114/283
5,076,189 A * 12/1991 Jones ..... 114/253
D331,439 S * 12/1992 Gibson ..... D21/770
D331,612 S * 12/1992 Woodard, Jr. ..... D21/770
5,247,898 A * 9/1993 Thornlimb ..... 441/65

* cited by examiner

*Primary Examiner*—Stephen Avila
(74) *Attorney, Agent, or Firm*—Charles C. Logan, II

(57) ABSTRACT

A recreational water sled that is designed to be towed by a speed boat or a jet ski. The water sled has an elongated boat body having a superstructure extending upwardly from its top surface. The superstructure has a rider seat portion and a nose portion having a dashboard located on its tear end. The top end of a steering column extends from the dashboard and it has a handle bar secured thereto. The bottom end of the steering column is secured to a rudder in the form of a ski or disk-shaped rudder. The front end of the boat body receives a tubular quick release housing that is structurally secured therein. A front end of a tongue assembly is releasably captured in the tubular quick release housing. The tongue assembly has a floating tow rope attachment assembly secured to its rear end. A hand actuated lever on the handle bar releases the tongue assembly from the boat body. The boat body has structure for producing a rooster tail water flow from the water beneath the water sled as it travels over the top surface of the water. The water flow is directed up through at least one passage way in the boat body and out through a nozzle extending from the top wall of said body boat.

11 Claims, 9 Drawing Sheets

RECREATION WATER SLED

BACKGROUND OF THE INVENTION

The present invention relates to recreational water devices and more specifically to water sleds which are designed to be towed behind a boat or jet ski.

The prior art includes several types of water sleds that can be towed. Some have surfaces that are contoured or otherwise adapted to allow the sled to be maneuvered by body weight shifting. Other types of water sled devices may be maneuvered by varying the point of attachment of a tow rope to the water sled. An additional type of water sled is steered by means of a rudder assembly.

The Willat U.S. Pat. No. 4,361,103 discloses a water sled device that includes a joystick for controlling a rudder and an elevator. A hydrofoil assembly extends downwardly from a forward section of the device and a flotation mattress may be attached to an upper surface of the device to provide for user comfort.

The Monreal U.S. Pat. No. 4,678,445 discloses a wishbone shaped sled that may be used on water and snow surfaces. The Monreal U.S. Pat. No. 4,678,444 discloses a water gliding scooter board to be towed by a speed boat.

The Moore et al U.S. Pat. No. 5,057,044 is directed to a water sled in which the rider stands upon a floatable disk with a vertical steering pole extending approximately to the chest height of a standing rider. A rudder is mounted on the bottom of the steering pole and a three point tow rope system is utilized with the water sled.

The Gibson U.S. Pat. No. D 331,439 and the Woodward U.S. Pat. No. D 331,612 disclose water sleds having differently shaped body housings.

The James U.S. Pat. No. 5,368,511 discloses a water sled used to transport cargo.

It is an object of the invention to provide a novel recreational water sled that has no engine but which can generate "rooster tail" streams of water flow much in the manner that jet skis produce.

It is also an object of the invention to provide a novel recreational water sled having a ski-shaped rudder or disk-shaped rudder that can be steered by a handlebar positioned above the dash of the water sled.

It is another object of the invention to provide a novel recreational water sled that has a unique quick release structure in its front end for releasably receiving the tongue assembly secured to the rear end of a tow rope.

It is an additional object of the invention to provide a novel recreational water sled that has a tow rope release mechanism that can be actuated by a tow line release lever mounted on the handlebar used to steer the water sled.

It is a further object of the invention to provide a novel recreational water sled that has alternative water scoop structure mounted on the bottom of the water sled for producing "rooster tail" like streams of water flow that can be directed upwardly from the top surface of the water sled and outwardly through nozzles whose pitch and angular orientation can be varied by controls on the dashboard of the water sled.

SUMMARY OF THE INVENTION

The novel recreational water sled has been designed to be towed by a speed boat and to generate the same maneuverability, speed and excitement as the motorized version of such watercraft commonly known as the Sea Doo, Wave Runner, etc. The water sled is designed to carry one or two riders. When under tow, the driver can steer the water sled left or right by turning the handlebar type steering wheel, which turns the bottom ski or optional disk-type rudder.

The water sled is provided with water scoops that are located in the bottom surface of the boat body. The water scoops are in communication with water passageways that direct the water outwardly through jet nozzles protruding from the top surface of the boat body. The water scoops are located adjacent the rear end of the water sled. When the water craft is under tow, the water is forced into the nozzles by the water scoops. This generates two jet streams of water flow that exit the jet nozzles and are projected high into the air behind the watercraft. This is commonly known as "rooster tail". The water nozzle's pitch and direction can be changed either manually or by a control knob or lever located on the front control panel. Both the pitch and the direction can be changed while the watercraft is under tow. The pitch adjustment is from thirty degrees to ninety degrees. The radius adjustment can be as much as 360 degrees. The water scoops can be fixed or controlled by moveable lever arms mounted adjacent the front end of the water sled. The water scoops are designed to normally be closed, and are open only during towing of the water sled.

The rider seat portion of the water sled has grab bars on its left and right sides to help a rider get back onto the sled from the water. There are recessed areas on the top surface of the boat body for the riders feet to keep them from slipping off the water sled during high speed cornering. The rider seat portion is padded for rider comfort.

When the rider has completed his ride, there is a quick release mechanism for the tow rope attached to the front end of the water sled. This allows the rider to swing into shore and release the tow line from the water sled. The release is completed by pulling a motorcycle-type lever on the handlebar. This disengages the tongue of the floating tow rope attachment assembly from the water sled. The tongue of the floating tow rope attachment assembly may later be reinserted into the quick release housing when the next rider is ready to go. The quick release mechanism is concealed within the bow of the water sled. The floating tow rope attachment assembly has the tongue connected thereto by a bi-directional hinge to eliminate any binding at the connection point. The boat body and its super-structure would preferably be made of hard durable plastic. The front cowling of the nose portion would be removable to access the quick release mechanism. The rider seat portion would also be removable to service the water scoops and the structure for allowing the flow of water to pass through them.

DESCRIPTION OF THE PREFERRED EMBODIMENT

Figure 1:
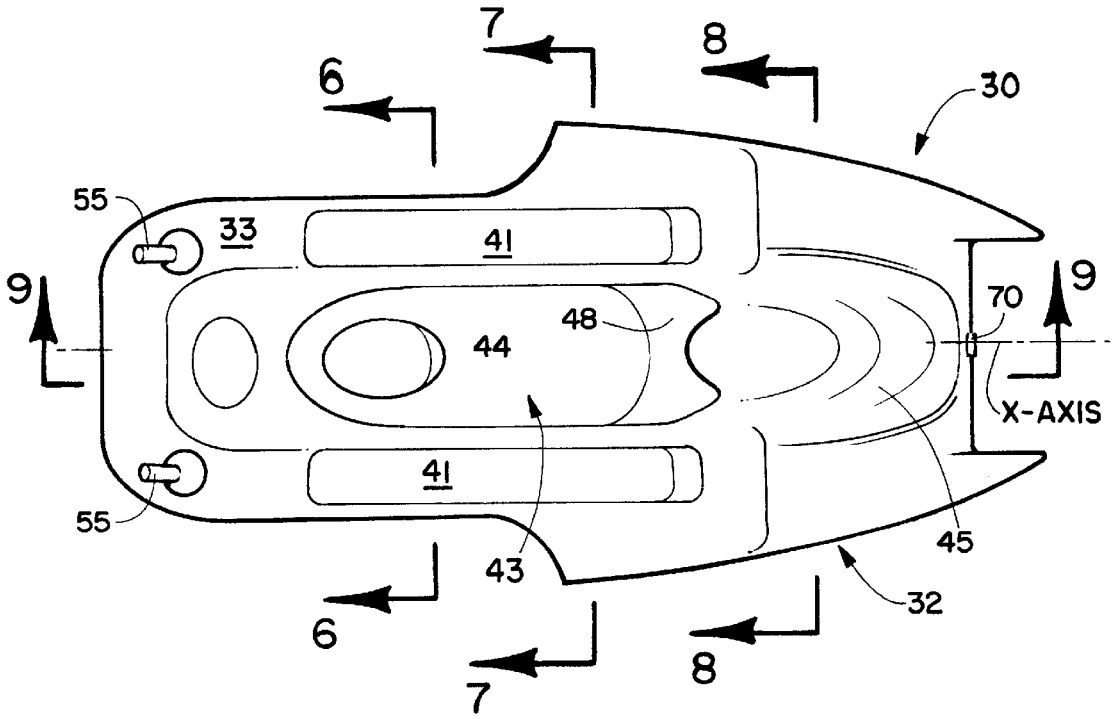
FIG. 1 is a top plan view of the novel recreational water sled and it has surface contour shading lines to clarify its shape.

The novel recreational water sled will now be described by referring to FIGS. 1–26 of the drawings.

The water sled is generally designated numeral 30. It has an elongated boat body 32 having a top wall 33, a bottom wall 34, a front wall 35, a rear wall 36 and a buoyancy air chamber 37. A port side hull 39 and a starboard side hull 40 are laterally spaced from each other and they extend downwardly from the bottom wall of boat body 32. Boat body 32 has an x-axis and there are laterally spaced foot recesses 41 formed in the top surface of the boat body. A superstructure 43 extends upwardly from the top surface of boat body 32 and it has a rider seat portion 44 and a nose portion 45. Hand grips 46 are mounted in the respective left and right lateral walls of the rider seat portion 44. A dashboard 48 is located on the rear end of nose portion 45. A steering column shaft 49 extends upwardly from dashboard 48 and it has a handlebar 50 mounted thereon for steering the water sled. A tow line release lever 51 is mounted on handlebar 50. A pair of laterally spaced tubular water scoops 53 extend downwardly and forwardly from bottom wall 34 of boat body 32. These water scoops are open at their front and rear ends. The rear end of the water scoops 53 are in communication with water passageways 54 that in turn are in communication with the tubular nozzles 55. The structure of the water scoops and the manner in which they are actuated will be described later.

Figure 2:
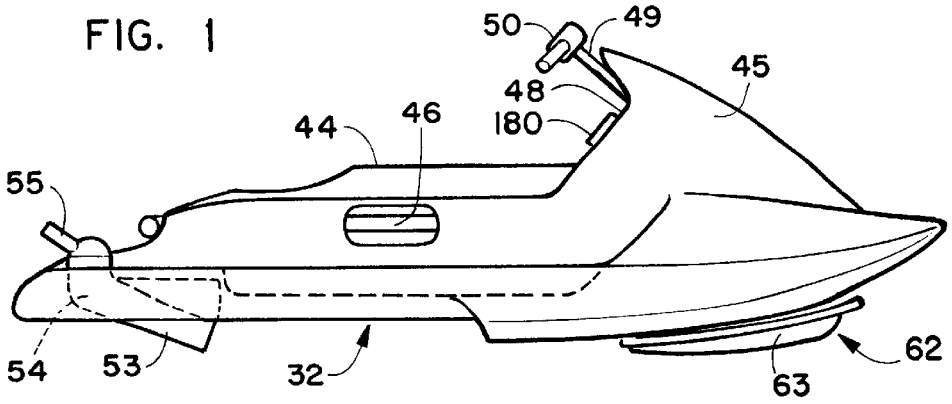
FIG. 2 is a side elevation view of the water sled.
Figure 3:
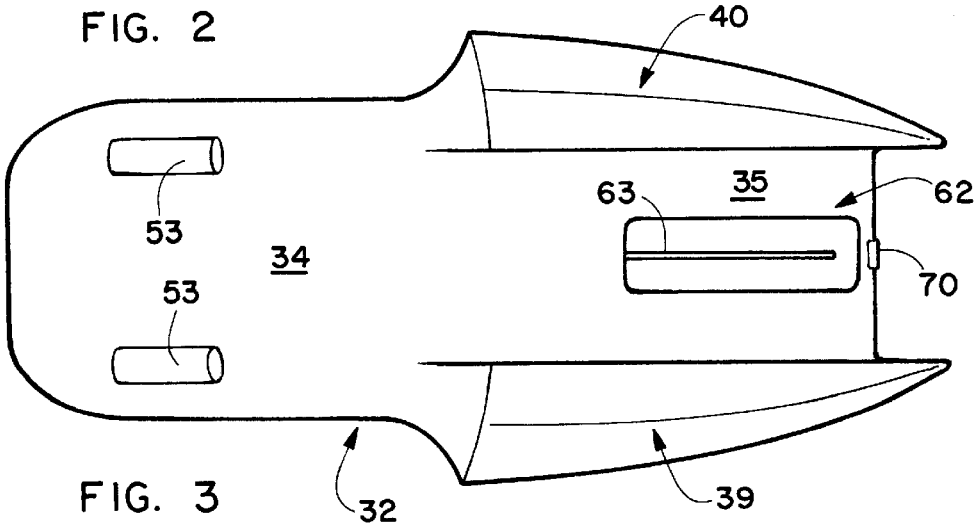
FIG. 3 is a bottom plan view of the water sled.
Figure 8:
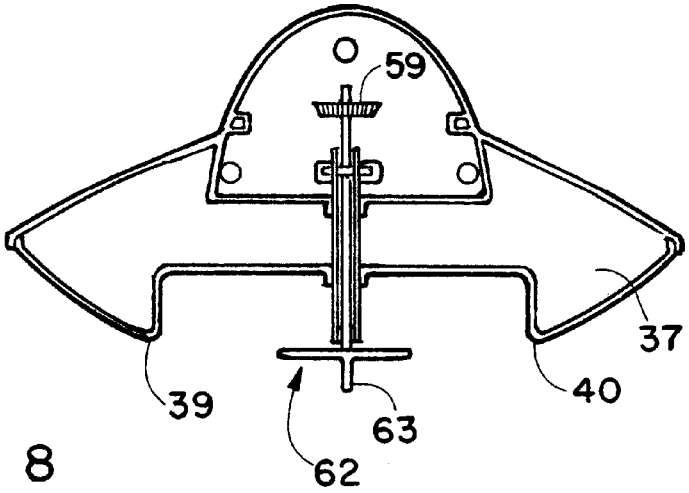
FIG. 8 is a schematic cross sectional view taken along lines 8—8 FIG. 1.
Figure 9:
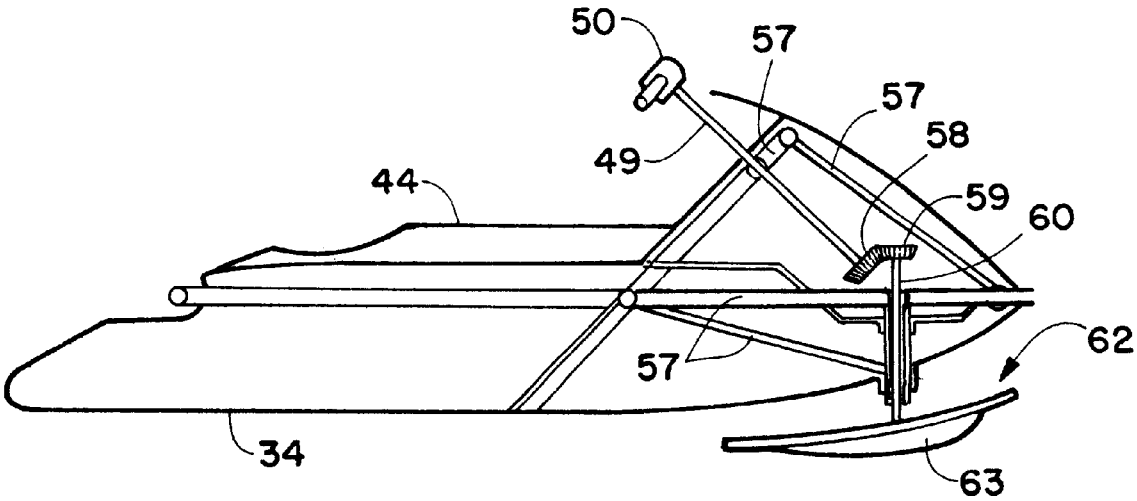
FIG. 9 is a schematic longitudinal vertical cross sectional view illustrating a first embodiment of the water sled steering structure.

One of the structures for steering the water sled will now be described by referring to FIGS. 2, 8 and 9. Steering column 49 would be journaled in a brace member 57 mounted beneath dashboard 48. A beveled gear 58 is mounted on the bottom end of steering column 49 and it meshes with beveled gear 59 mounted adjacent the top end of steering shaft 60. Numerous support brace members 57 would be utilized within boat body 32 and nose portion 45 to support the steering structure for the water sled. The bottom end of steering shaft 60 is connected to the top surface of a ski-shaped rudder 62 having a longitudinally extending fin 63.

Figure 10:
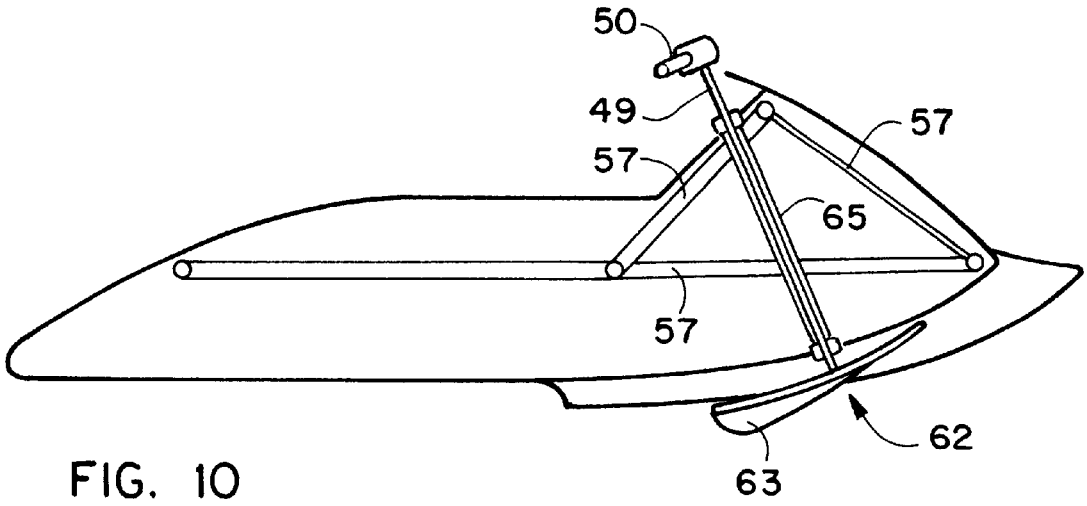
FIG. 10 is a schematic longitudinal vertical cross sectional view illustrating a second embodiment of the water sled steering structure.
Figure 11:
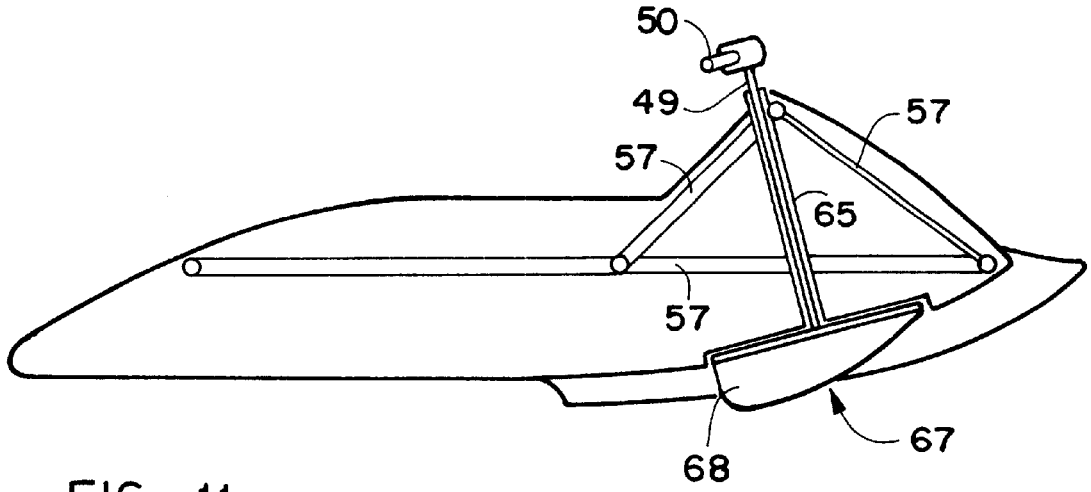
FIG. 11 is a schematic longitudinal vertical cross sectional view illustrating a third embodiment of the water sled steering structure.
Figure 12:
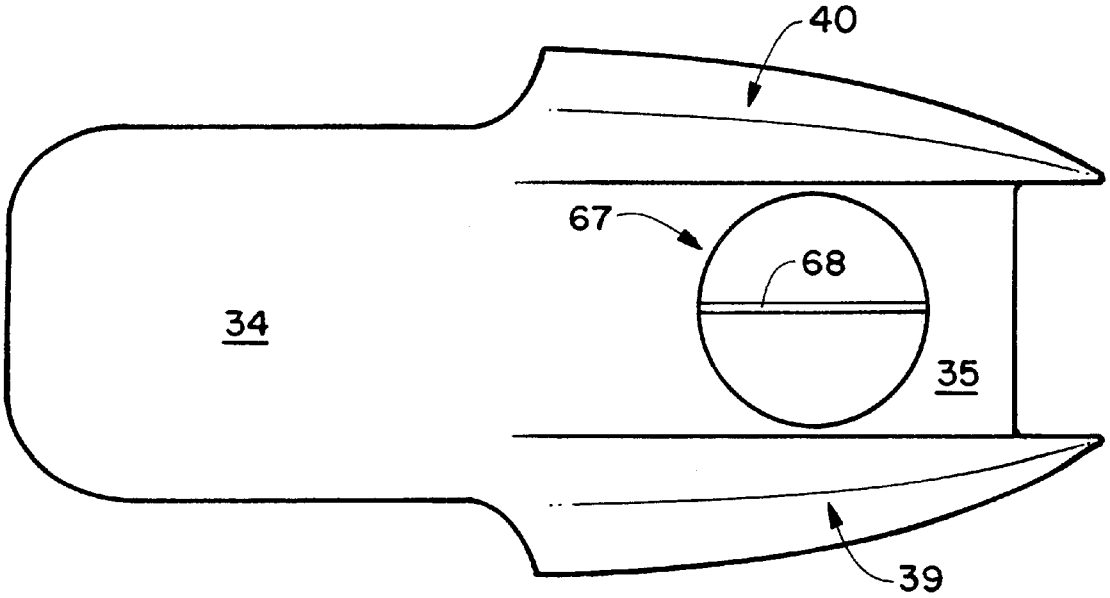
FIG. 12 is a schematic bottom plan view of the embodiment illustrated in FIG. 11.
Figure 13:
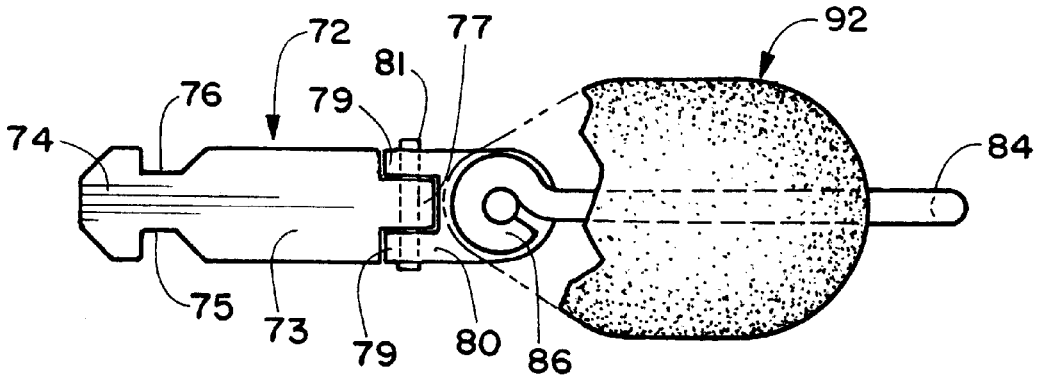
FIG. 13 is a top plan view of the tongue assembly for detachably securing a tow rope to the front end of the water sled.
Figure 14:
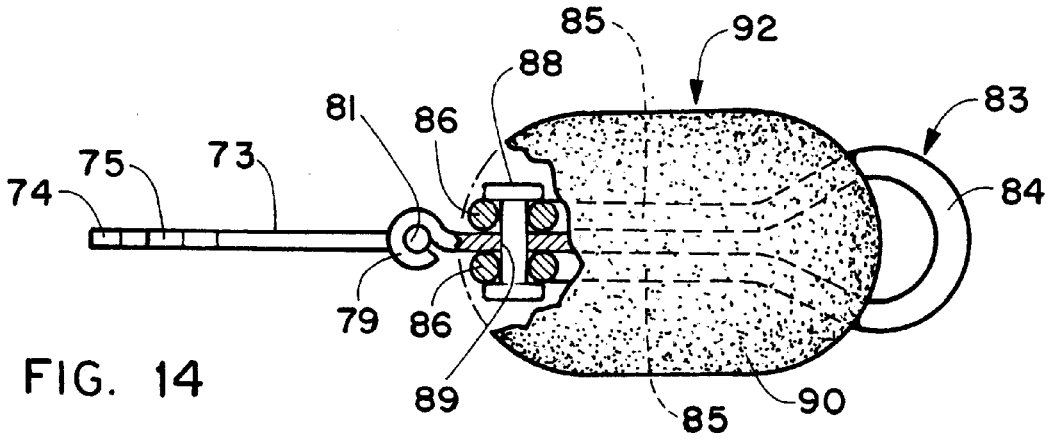
FIG. 14 is a side elevation view of the novel tongue assembly.
Figure 17:
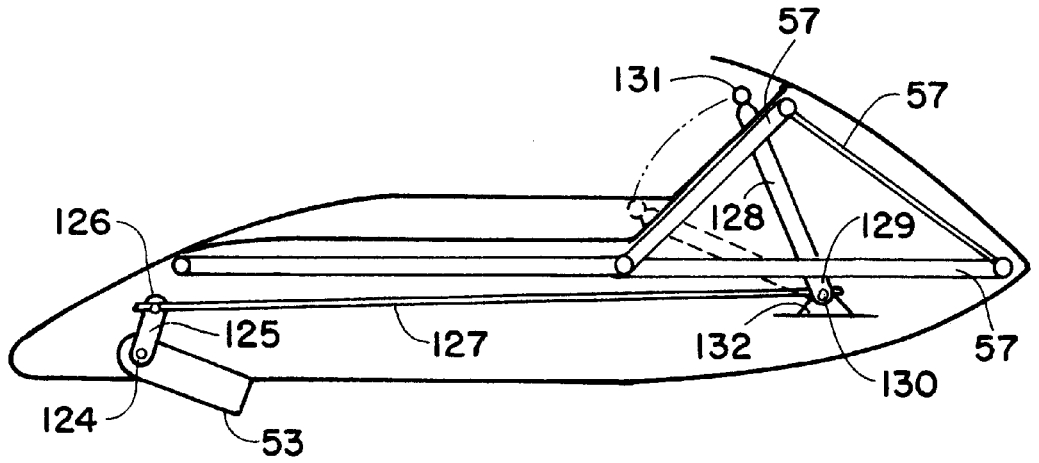
FIG. 17 is a schematic longitudinal vertical cross sectional view of the later sled illustrating the rooster tail flow control structure.

An alternative structure for steering ski-rudder 62 is illustrated in FIG. 10. steering column 49 passes downwardly through a sleeve 65 in which it is journaled at both its top and bottom ends. The bottom end of steering column 49 is secured to the top surface of ski-shaped rudder 62. Several brace members 57 are used to properly support the structure for steering the water sled. In FIGS. 11 and 12 a disk-shaped rudder 67 having a fin 68 is secured to the bottom end steering column 49.

Figure 4:
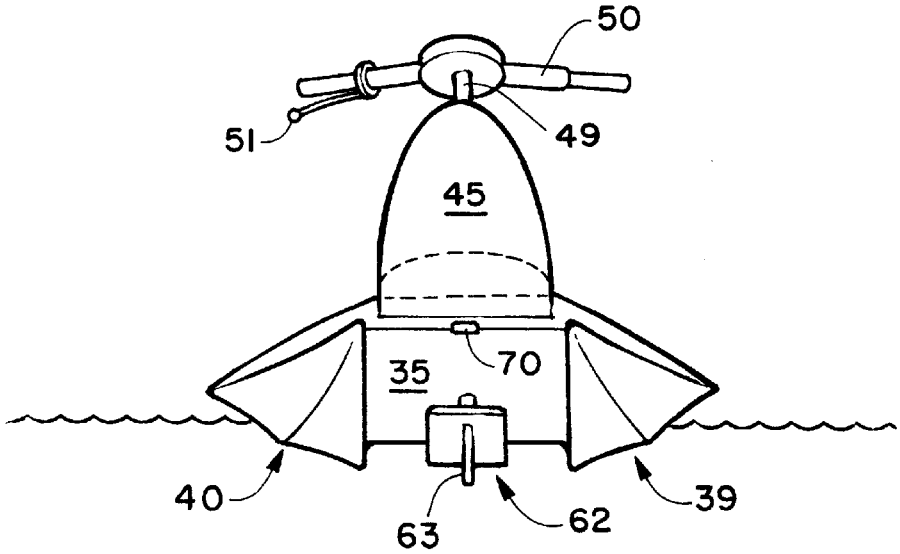
FIG. 4 is a front elevation view of the water sled.
Figure 5:
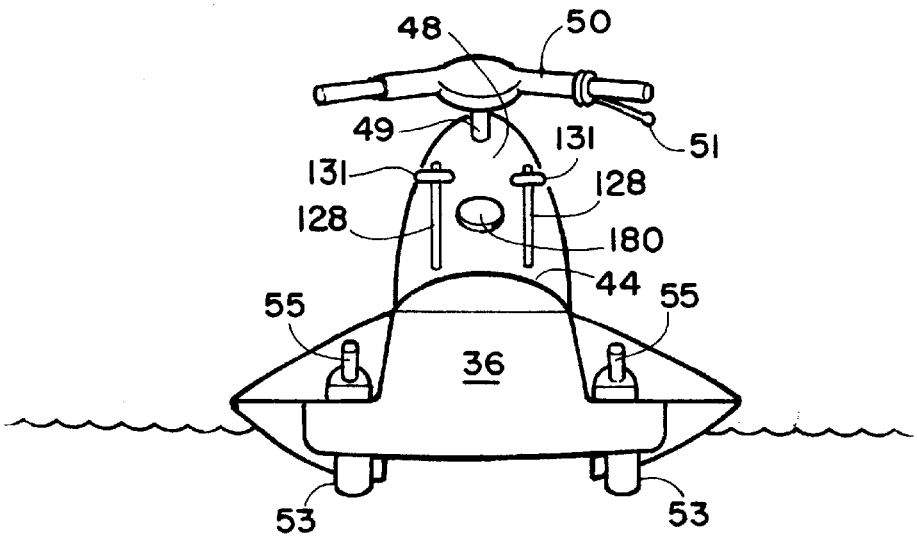
FIG. 5 is a rear elevation view of the water sled.
Figure 6:
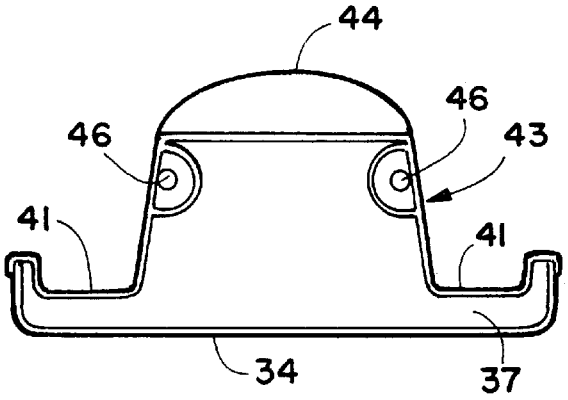
FIG. 6 is a schematic cross sectional view taken along lines 6—6 of FIG. 1.
Figure 7:
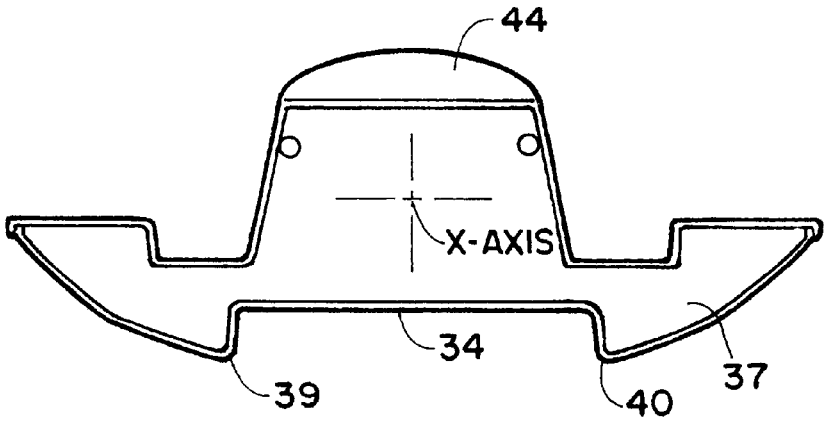
FIG. 7 is a schematic cross sectional view taken along lines 7—7 of FIG. 1.
Figure 15:
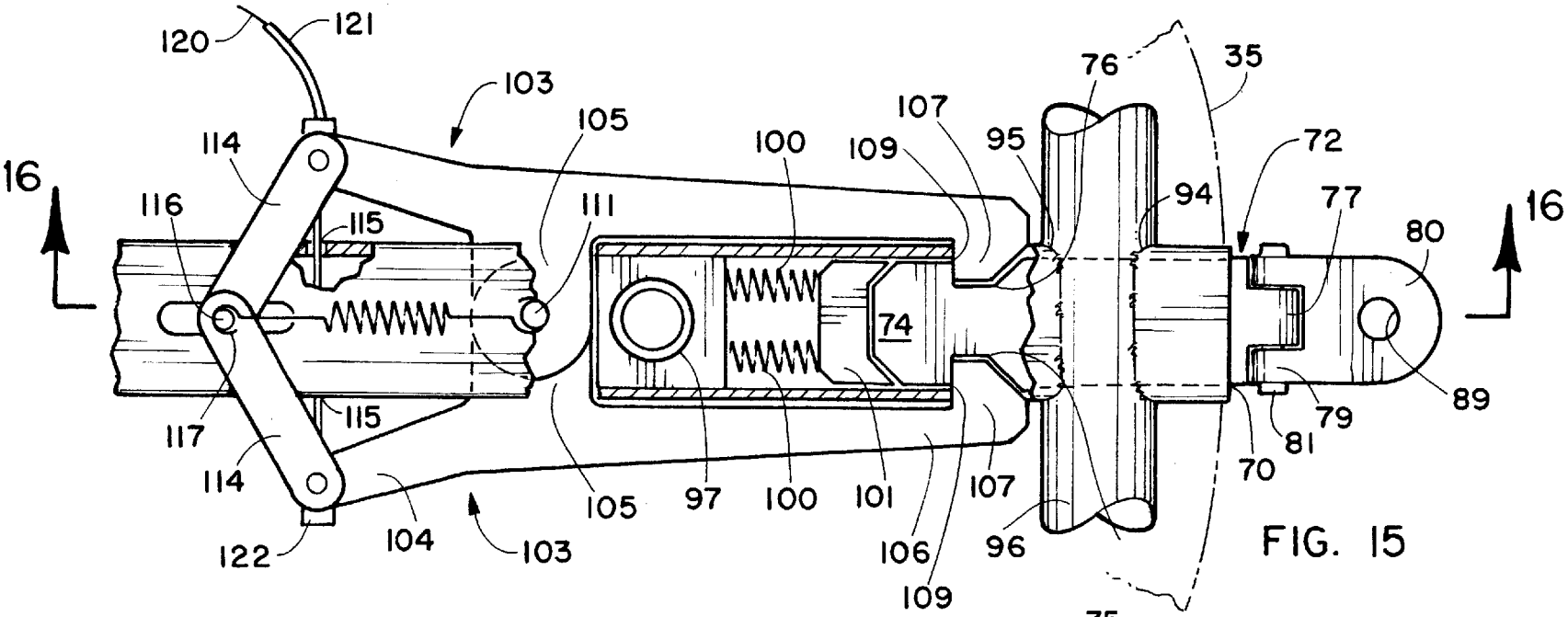
FIG. 15 is a schematic top plan view of the quick release structure for the tongue assembly that is mounted in the front end of the water sled.
Figure 16:
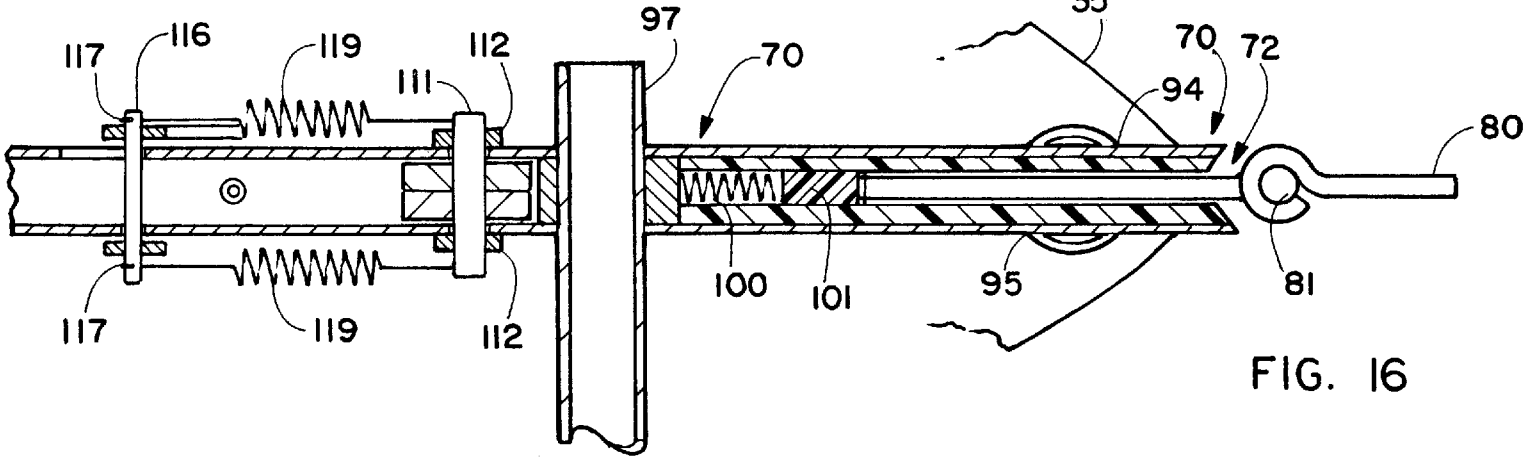
FIG. 16 is a schematic vertical cross sectional view taken along lines 16—16 of FIG. 15.
Figure 18:
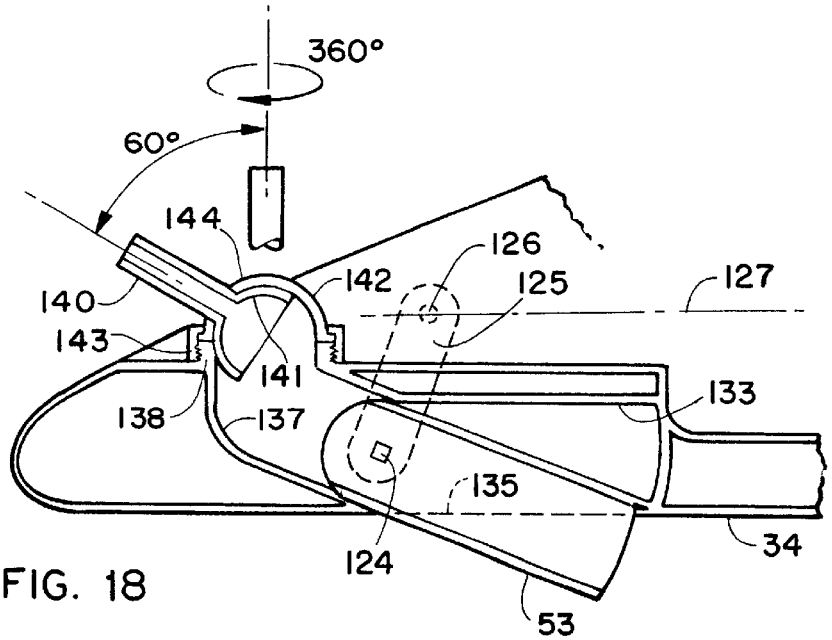
FIG. 18 is a schematic vertical cross sectional view of a first embodiment of the inlet scoop assembly.

The quick release structure for detachably releasing a tow line from the front end of the water sled will be best understood by referring to FIGS. 4 and 13–16. The open front end of the tubular quick release housing 70 is seen in FIGS. 4, 15, and 16. Tongue assembly 72, which is releasably inserted therein, will be discussed in detail by referring to FIGS. 13 and 14. Tongue assembly 72 has a flat strip of metal having an insertion portion 73, a head portion 74, a left side notch 75 and a right side notch 76. A circular shaped tongue 77 extends from the rear end of insertion portion 73. Circular tongue 77 aligns with laterally spaced circular fingers 79 on attachment plate 80 and a hinge pin 81 is inserted through the respective members.

Secured to the rear end of attachment plate 80 are the respective opposite ends of a closed loop attachment cable 83. Closed loop attachment cable 83 has a loop portion 84, a pair of laterally spaced shank portions 85 and a pair of laterally spaced circular attachment tips 86. An I-shaped attached pin 88 is inserted through the respective aligned circular attachment tips 86 and aperture 89 in attachment plate 80. A float body 90 of suitable floatation material covers most of the structure of the floating tow rope attachment assembly 92 that has just been described.

Tubular quick release housing 70 passes through front and rear slots 94 and 95 of cross beam 96. Vertical beam 97 passes through aligned top and bottom apertures in tubular quick release housing 70. A sleeve 99 is inserted into the front end of tubular quick release housing 70. Also therein are a pair of laterally spaced rings 100 and a buffer pad 101. A pair of bellcrank arms 103 each have a rear arm portion 104, a transversely extending pivot arm 105, and a front arm portion 106 having an inwardly extending jaw 107. The respective jaws 107 pass through cutout slots 109 in the respective left and right side walls of quick release housing 70. This allows the jaws 107 to engage the respective left and right side notches 75 and 76 of tongue assembly 72.

Pivot arms 105 of respective bellcrank arms 103 are vertically stacked with respect to each other and have a pin 111 passing through aligned apertures in the respective pivot arms 105. Lock nuts 112 secure the top and bottom of pin 111. Linkage arms 114 are pivotally connected to the respective rear ends of rear arm portions 104. Linkage arms 114 pass through apertures 115 in the respective left and right side walls of tubular quick release housing 70. A pin 116 passes through aligned apertures in the ends of linkage arms 114 and are secured thereto by lock nuts 117. Slots 118 in the top and bottom walls of tubular quick release housing 70 allow pin 116 to travel axially there along. Springs 119 keep pin 116 at the forward end of slot 118 and thereby keep the respective jaws 107 in engagement with the notches 75 and 76 of tongue assembly 72. A cable 120 passes through a sheath 121 and has its one connected to tow line release lever 51 on handlebar 50. The other end of cable 120 is connected to clamp 122 of the left rear arm portion 104. By squeezing the lever of tow line release 51, the rear arm portions 104 are pulled toward each other and this results in jaws 107 releasing from notches 75 and 76 of tongue assembly 72.

Figure 19:
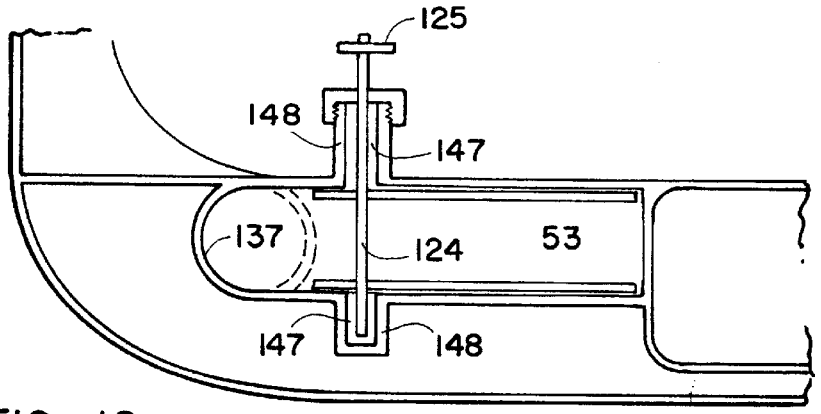
FIG. 19 is a schematic top plan view of the inlet scoop embodiment illustrated in FIG. 18.

The manner in which water scoop 53 is actuated to scoop up water from beneath the bottom wall of the boat body will be described by referring to FIGS. 5, 17, 18 and 19. Water scoop 53 is pivotal between an up and a down position about pivot pin 124 that is rigidly mounted therein. A lever arm 125 is rigidly attached at its bottom end to water scoop 53 by pivot pin 124. The top end of lever arm 125 is pivotally connected about a pin 126 to the rear end of connecting rod 127. The front end of connecting rod 127 is pivotally connected to movable lever arm 128 by a pivot pin 129. The bottom end of lever arm 128 is pivotally mounted to a fixed bracket 132 by pivot pin 130. When the handle 131 of lever arm 128 is moved forward, water scoop 53 is at its lowest open position and there is a full flow of water passing therethrough. By pulling handle 131 to its rearwardmost position, water scoop 53 is retracted upwardly into storage recess 133 in the bottom wall 34 to cover the bottom of elongated cutout 135. The rear end of water scoop 53 is in communication with water passageway 137 and it has a flange 138 that projects upwardly above the top surface of top wall 33. A nozzle 140 having a hemispherical base 141 is captured in hemispherical cap 142 and secured thereto by locking cap 143. A slot 144 in hemispherical cap 142 allows nozzle 140 to be pivoted through a range of approximately 60 degrees. Referring to FIG. 19, it can be seen at the opposite ends of pivot pin 124 are journaled in nylon bearings 147 mounted in sleeves 148.

Figure 20:
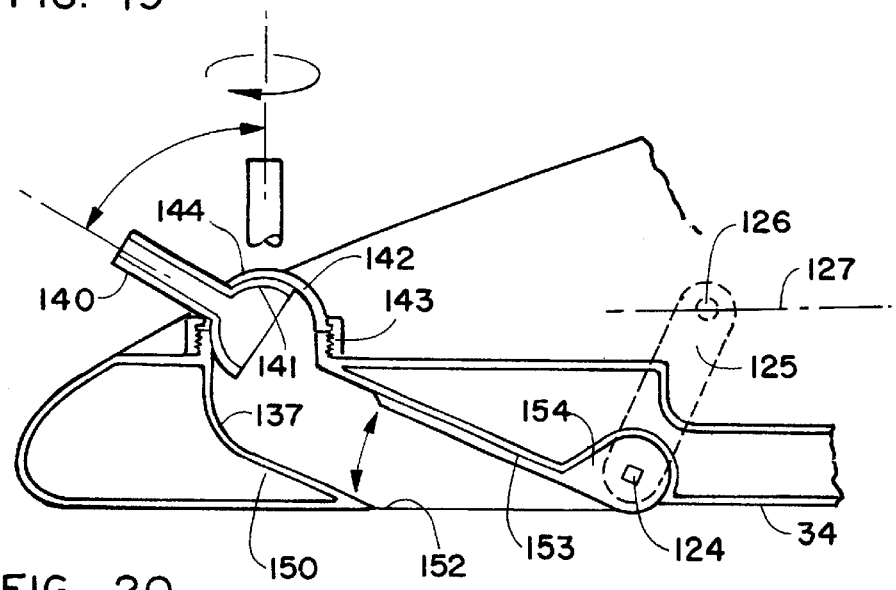
FIG. 20 is a schematic vertical cross sectional view of a second embodiment of the inlet scoop assembly.
Figure 21:
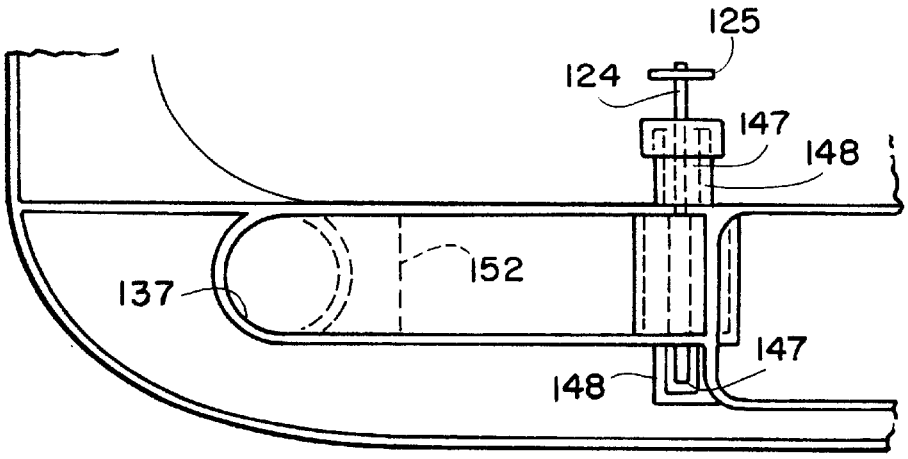
FIG. 21 is a schematic top plan view of the inlet scoop embodiment illustrated in FIG. 20.

A first alternative embodiment water scoop 150 is illustrated in FIGS. 20 and 21. Bottom wall 34 has an elongated cutout inlet aperture 152 that is closed by a gate 153 that has a pair of laterally spaced flanges 154 through which passes pivot pin 124. Forward motion on handle 131 to its forwardmost position results in gate 153 being pivoted into its uppermost position and allows for full water flow. Pulling handle 131 to its rearmost position causes gate 153 to be pivoted downwardly until it closes the inlet aperture 152 which results in no water flow. The nozzle 140 functions exactly in the same manner as the previous embodiment.

Figure 22:
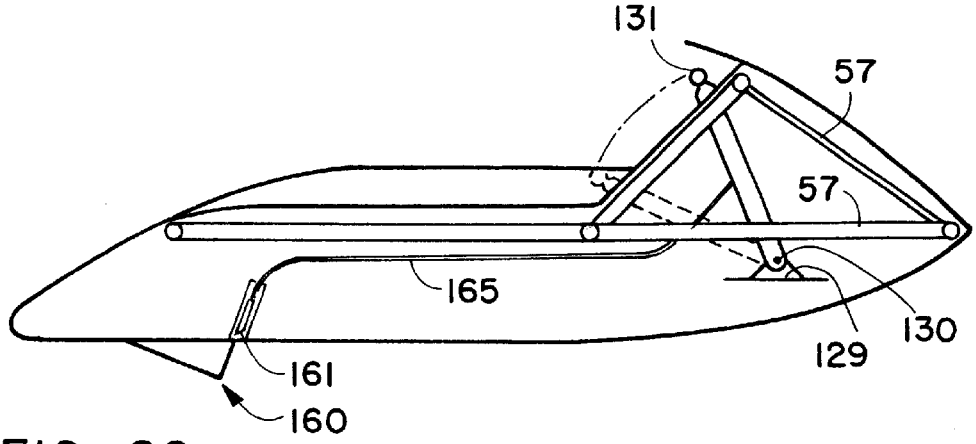
FIG. 22 is a schematic longitudinal vertical cross sectional view of a third embodiment of the inlet scoop assembly and the structure for actuating it.
Figure 24:
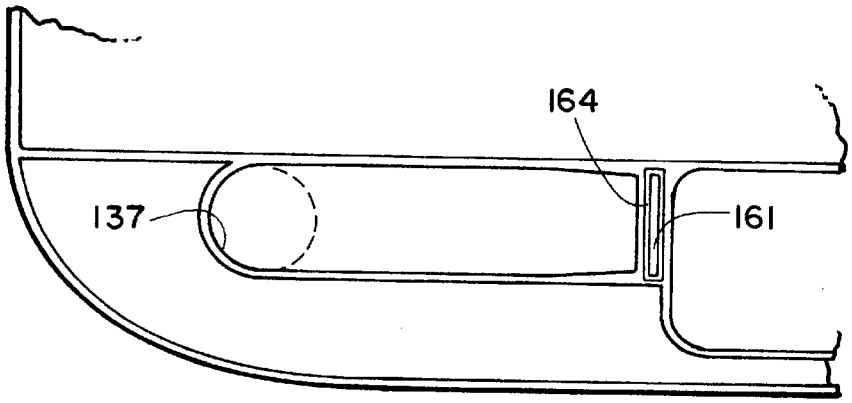
FIG. 24 is a top plan view of the inlet scoop embodiment illustrated in FIG. 23.
Figure 23:
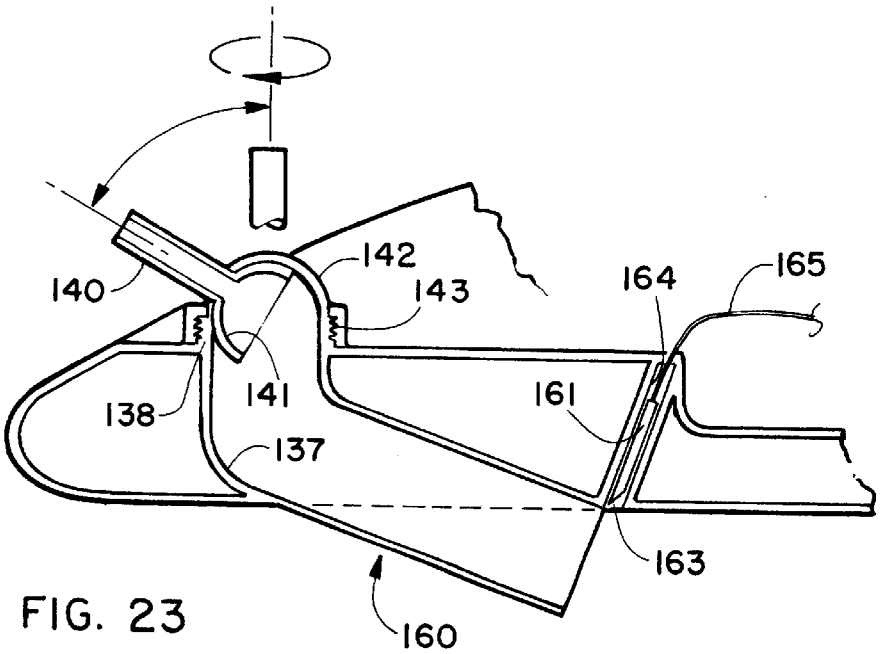
FIG. 23 is a schematic vertical cross sectional view of the third embodiment of the inlet scoop assembly.

A second alternative embodiment water scoop is illustrated in FIGS. 22, 23 and 24. Water scoop 160 permanently extends down below the bottom surface of bottom wall 34. It's rear end is in communication with passageway 137 and conventional nozzle 140 and its related structure. A sliding door or gate 161 in its lowermost position covers the front opening of scoop 160. When gate 161 is withdrawn into the slot 163 formed in sleeve 164, there will be full water flow entering water scoop 160 and exiting jet nozzle 140. The top end of gate 161 would be secured to a cable 165 that passes through a sheath and whose forward end is connected to lever arm 128. Cable 165 is a flexible cable with rigid ends inside a flexible sheath. When handle 131 is pulled down to its rearward most position, gate 161 will be slid over the front opening of water scoop 160 and there will be no water flow therethrough.

Figure 25:
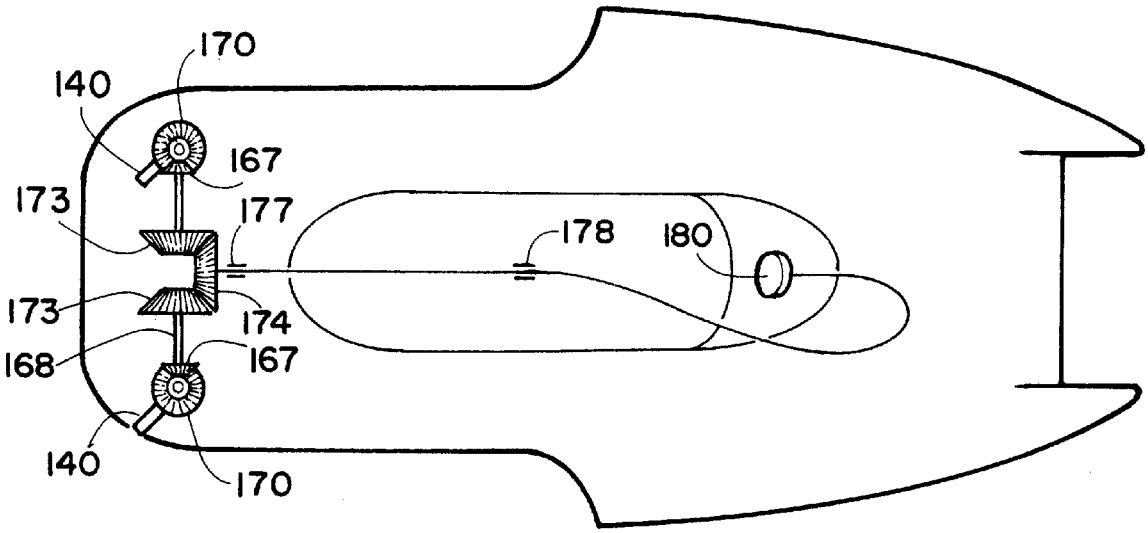
FIGS. 25 and 26 are schematic top and side elevation views of the structure utilized for rotating the rooster tail nozzle about vertical axes.
Figure 26:
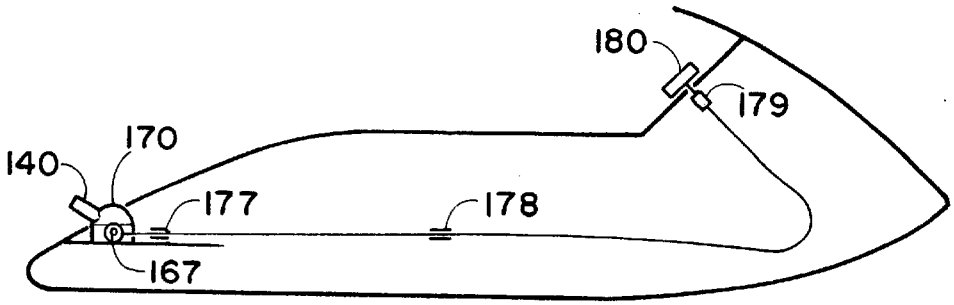

In FIGS. 25–26 there is disclosed a system for radially rotating the direction of nozzle 140. The water passageways 137 are in communication with nozzle 140. Flanges 138 extending upwardly from the top wall surface of the boat body 32 would have a recess 166 for receiving a gear 167 mounted on a shaft 168. The bottom surface of hemispherical cap 70 would have gear teeth recesses in its bottom surface that would mate with the gears 167. Since hemispherical cap 170 has freedom to rotate within locking cap 170, it can rotate for azimuth adjustment throughout 360 degrees. The inner end of shaft 168 has a beveled pinion gear 173 mounted thereon that meshes with another beveled gear 174 that is mounted on a cable 175. The sheath of the cable is anchored at 177 and 178 and also at 179. The free end of the cable passes through the dashboard and is rigidly connected to rotating control wheel 180. It can be understood that by rotating control wheel 180 the respective nozzles 140 at the rear end of water sled can be rotated about 360 degrees in azimuth adjustment.

What is claimed is:

1. A recreational water sled comprising:

an elongated boat body having a side, a starboard side, a bow, a stern and a longitudinally extending x-axis; said boat body having a front wall, a rear wall, a bottom wall, and a top wall having a top surface; a buoyancy chamber is formed between said top wall, said bottom wall, said front wall and said rear wall; and elongated port side hull and a starboard side hull are laterally spaced from each other and they extend downwardly from the bottom wall of said boat body;

a superstructure extending upwardly from the top surface of said boat body; said superstructure having a rider seat portion; a nose portion having a rear end having a left side wall and a right side wall; and said nose portion having a dashboard located on its rear end;

means for detachably connecting a tow line to the bow of said water sled comprising:

a longitudinally extending quick release housing having an open front end;

said quick release housing being mounted in the bow of said boat body;

a tongue assembly having a front end, a rear end, a left side end, a right side end, attachment means for detachably securing the front end of said tongue assembly to said quick release housing;

hand actuation means for releasing said attachment means from the front end of said tongue assembly.

2. A recreation water sled as recited in claim 1 wherein said tongue assembly has an insertion portion having a head portion, a left side notch and a right side notch; a closed loop attachment cable is secured to the rear end of said tongue assembly.

3. A recreation water sled as recited in claim 2 further comprising a flat body surrounding a major portion of said closed loop attachment cable thereby making said tongue assembly floatable in the water.

4. A recreation water sled as recited in claim 2 wherein said attachment means comprises a bell-crank assembly having a left jaw and a right jaw that detachably engage the respective left and right notches of the insertion portion of said tongue assembly.

5. A recreational water sled comprising:

an elongated boat body having a port side, a starboard side, a bow, a stern and a longitudinally extending x-axis; said boat body having a front wall, a rear wall, a bottom wall and a top wall having a top surface; a buoyancy chamber is formed between the top wall, said bottom wall, said front wall and said rear wall; an elongated port side hull and a starboard side hull are laterally spaced from each other and they extend downwardly from said bottom wall of said boat body;

a superstructure extending upwardly from said top surface of said boat body; said super structure having a rider seat portion having a left side wall and a right side wall and a nose portion having a rear end; said nose portion having a dashboard located on said rear end;

means for scooping up water through an inlet port in said bottom wall of said boat body and directing it upwardly through a water passageway that has an outlet port in said top wall of said boat body; an upwardly oriented elongated nozzle connected to said port outlet for directing a rooster tail stream of water flow up into the air; and means mounted on said dashboard for opening and closing said inlet port of said boat body to start and stop the production of said rooster tail stream of water flow.

6. A recreational water sled as recited in claim 5 wherein said means for scooping up water is an elongated tubular water scoop member having an open front end and an open rear end; said front end extends outwardly through said inlet port in the bottom wall of said boat body; the rear end of said water scoop member being in communication with said water passageway in said boat body; the rear end of said water scoop member being mounted on a horizontal pivot pin and means for pivoting said water scoop member up into the boat body and closing the inlet port in the bottom wall of said boat body.

7. A recreational water sled as recited in claim 5 wherein said means for scooping up water is an elongated tubular water scoop member having an open front end and an open rear end; said open front end is contiguous with the inlet port in the bottom wall of said boat body; an elongated gate having a front end and a rear end; the front end of said gate being mounted on a horizontal pivot pin means for pivoting said gate upwardly into said water scoop for a full flow position and downwardly into a position in which said gate closes the inlet port in the bottom wall of said boat body.

8. A recreational water sled as recited in claim 5 wherein said means for scooping up water is an elongated tubular water scoop member having an open front end and an open rear end; said front end extends through said inlet port in said bottom wall of said boat body so that it is rigidly positioned vertically spaced below said bottom wall; an upright oriented sleeve in said boat body having an open bottom end, said open end being positioned adjacent the front end of said water scoop member; a gate reciprocally mounted in said upright oriented sleeve and means for forcing said gate downwardly to a position where it will close said front end of said water scoop member.

9. A recreational water sled as recited in claim 5 further comprising means mounted on said dashboard for controlling the radial rotation of said water flow nozzles.

10. A recreational water sled as recited in claim 5 further comprising means for adjusting the vertical pitch of said water nozzles.

11. A recreational water sled comprising:

an elongated boat body having a port side, a starboard side, a bow, a stern and a longitudinally extending x-axis; said boat body having a front wall, a rear wall, a bottom wall, and a top wall having a top surface; a buoyancy chamber is formed between said top wall, said bottom wall, said front wall and said rear wall; an elongated port side hull and a starboard side hull are laterally spaced from each other and they extend downwardly from said bottom wall of said boat body;

a superstructure extending upwardly from said top surface of said top wall of said boat body; said superstructure having a rider seat portion and a nose portion; said nose portion having a rear end; said rider seat portion having a left side wall and a right side wall; said nose portion having a dashboard located on said rear end;

means for detachably connecting a tow line of a bow of said water sled; and means for steering said water sled comprising a handle bar, a steering column having a top end and a bottom end, and a rudder having a top surface and a bottom surface; said rider having a disc-shaped body having a bottom surface; a longitudinally extending fin extends downwardly from said bottom surface of said disc-shaped body; said top end of said steering column passes through said dashboard and is connected to said handlebar; said bottom end of said steering column being mechanically connected to said top surface of said rudder.

* * * * *